US006433323B2

(12) United States Patent
Kim

(10) Patent No.: US 6,433,323 B2
(45) Date of Patent: Aug. 13, 2002

(54) DAMPER APPARATUS FOR A MICROWAVE OVEN

(75) Inventor: Seog Tae Kim, Changwon (KR)

(73) Assignee: LG Electronics Inc. (KR)

( * ) Notice: Subject to any disclaimer, the term of this patent is extended or adjusted under 35 U.S.C. 154(b) by 0 days.

(21) Appl. No.: 09/520,328

(22) Filed: Mar. 7, 2000

(30) Foreign Application Priority Data

Aug. 27, 1999 (KR) ..... 99-35944

(51) Int. Cl.[7] ..... H05B 6/68
(52) U.S. Cl. ..... 219/757; 219/702; 126/21 A
(58) Field of Search ..... 219/757, 702, 219/400; 126/21 A, 21 R

(56) References Cited

U.S. PATENT DOCUMENTS

| | | | | |
|---|---|---|---|---|
| 4,208,572 A | * | 6/1980 | Melgaard | 219/400 |
| 4,307,286 A | * | 12/1981 | Guibert | 219/400 |
| 4,448,578 A | * | 5/1984 | Brunt et al. | 432/72 |
| 4,450,344 A | * | 5/1984 | Sakoda et al. | 219/757 |

FOREIGN PATENT DOCUMENTS

| | | | | |
|---|---|---|---|---|
| JP | 2-199789 | * | 8/1990 | 219/757 |
| JP | 4-161725 | * | 6/1992 | |
| JP | 6-2860 | * | 1/1994 | 219/757 |
| JP | 6-94243 | * | 4/1994 | 219/757 |

* cited by examiner

*Primary Examiner*—Philip H. Leung
(74) *Attorney, Agent, or Firm*—Ostrolenk, Faber Gerb & Soffen, LLP

(57) ABSTRACT

The present invention relates to a damper apparatus for a microwave oven by which the production cost and the reliability of the operation can be obtained by simplifying the structure of a damper apparatus for controlling the air flow supplied into the cavity of a microwave oven, which comprises an air duct for guiding a cooling air from the machinery compartment of the microwave oven into the cavity; a damper rotatably installed in the air duct for opening or closing the air flow in the air duct; a motor which includes a shaft directly connected to the damper to drive the damper; and a micro switch installed at one side of the air duct for detecting the opening and closing states of the damper by contacting one side of the damper.

5 Claims, 2 Drawing Sheets

DAMPER APPARATUS FOR A MICROWAVE OVEN

BACKGROUND OF THE INVENTION

1. Field of the Invention

The present invention relates to a damper apparatus for controlling the flow of air which is supplied into an oven cavity in a machinery compartment of a microwave oven and, more particularly, to a damper apparatus for a microwave oven in which the structure of the damper apparatus is simplified to thereby reduce the production cost and obtain the reliability of the operations at the same time.

2. Description of the Prior Art

A microwave oven is an apparatus in which microwave is generated by applying current, the thusly generated microwave is introduced into an oven cavity, a space for accepting a heating object, for thereby heating the heating object.

Such a microwave oven has various functions due to the diversification of required heating characteristics. For instance, a product having a heater for heating food at a higher temperature therein is developed.

The microwave oven having such a heater is advantageous because it can have more various heating characteristics compared to conventional microwave ovens, escaping from a single heating characteristic utilizing microwave.

That is, it is possible to heat food at a higher temperature and brown the surface of food using an electric heater.

And, the microwave oven forms an air flow for exhausting steam or smoke generated by heating, in the cavity which is a space for heating.

FIG. 1 is a perspective view illustrating a general microwave oven which is divided into a cavity (C), a space for heating food by a partition 11, which is opened or closed by a door 12, and a machinery compartment 10 which has a microwave generating unit for generating microwaves.

The machinery compartment 10 includes a high voltage transformer 13 for boosting a supplied current to a high voltage, a magnetron 14 for oscillating microwave using a high voltage supplied by the high voltage transformer 13, a cooling assembly 20 for radiating the high voltage transformer 13 and the magnetron 14 which generate much heat when driving the microwave oven, an air duct 15 which allows a part of cooling air generated in the cooling assembly 20 to cool the high voltage transformer 13 and the magnetron 14 to thereafter introduce the same into the cavity (C).

Herein, the path through which the part of cooling air is introduced into the cavity will be described as follows.

The cooling air generated in the cooling assembly 20 is guided through the air duct 15 installed adjacent to the magnetron 14, and introduced into the cavity (C) through a plurality of air vents(not shown) formed on the partition 11 which partitions between the cavity (C) and the machinery compartment 10.

That is, the partition 11 corresponding to the inside of the air duct 15 has an inlet port including a plurality of air vents(not shown) formed thereon, and the cooling air guided through the air duct 15 is introduced into the cavity through the inlet port.

And, the thusly introduced cooling air is exhausted to the outside of the microwave oven through an outlet port(not shown) formed on the opposite wall of the cavity, along with steam or smoke generated in the cavity (C).

In the microwave oven having a heater(not shown) thus described, when heating food using the heater(not shown), the cavity (C) in which the food is placed has a very high temperature, and heat of such a high temperature gradually heats the food.

By such a heating operation using the heater, food is heated by itself, or at the same time using microwave oscillated by the magnetron 14.

In the case that food has to be heated at a high temperature as described above, it is not preferred that the cooling air from the cooling assembly 20 is introduced into the cavity (C).

That is, when the cooling air of a low temperature is introduced into the cavity and exhausted to the outside, the loss of heat is actually large.

Thus, the cooling air of a low temperature must be selectively introduced into the cavity (C) through the air duct 15. As an example of the above-described construction, U.S. Pat. No. 4,450,344 will be described as follows with reference to FIG. 2.

FIG. 2 is a block diagram illustrating the construction of a conventional damper apparatus for a microwave oven. As shown therein, the cooling air from the cooling fan assembly 20 can be selectively introduced into the cavity (C) by allowing a damper 30 to open or close the inlet port 16 which is a path into the cavity (C).

More specifically, the damper apparatus includes a cam member 40 to which the rotation of a motor 41 is transferred; a damper link 31 which is eccentrically connected to the cam member 40; a damper 30 for opening or closing the inlet port 16 in which one end 30*a* is connected to the damper link 31, and the other end is rotatably connected to one side of the partition 11; and a micro switch which is installed at one side of the cam member 40 for thereby detecting the rotation volume of the cam member 40.

The operation mode of the thusly constructed damper apparatus is as follows. The rotation of the motor 41 is transferred to the cam member 40 for rotation purposes, the damper 30 is interlocked with the damper link 31 which is connected to the cam member 40, thereby opening or closing the inlet port 16, and the open state and the close state are detected by the micro switch 50 for sensing the rotation volume of cam member 40

However, the above-described damper apparatus has problems that the mechanical elements for transferring the rotation of the motor (M) to the damper 30 are complicated so that the production unit price is increased and the assembly characteristics are deteriorated.

In addition, since the micro switch 50 for detecting whether the damper opens or closes the inlet port 16 is constructed to contact the cam member 40 for thereby detecting the open and close states of the damper by sensing the rotation angle thereof, the micro switch 50 cannot directly detect the damper 30. Thus, there arises another problem that it is difficult to detect the full-open state of the damper 30 due to the clearances between the complex elements or the combination of assembly allowances.

Furthermore, there is still another problem that because it is difficult for the damper to fully open or close the inlet port, a gap is generated and thus a cooling air is introduced.

SUMMARY OF THE INVENTION

Accordingly, it is an object of the present invention to provide a damper apparatus for a microwave oven in which a rotation shaft of a damper and a rotation shaft of a driving motor are formed in one united body in order to simplify the damper and its peripheral construction and control the damper accurately.

To achieve the above object, there is provided a damper apparatus for a microwave oven which includes an air duct for guiding a cooling air from the machinery compartment of the oven into the cavity; a damper rotatably installed in the air duct for opening or closing the flow of air in the air duct; a motor which includes a shaft directly connected to the damper to thereby drive the damper; and a micro switch installed at one side of the air duct for detecting the opening and closing states of the damper by contacting one side of the damper.

Additional advantages, objects and features of the invention will become more apparent from the description which follows.

BRIEF DESCRIPTION OF THE INVENTION

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of a damper apparatus for a microwave oven according to the present invention will be described as follows with reference to the accompanying drawings.

Figure 1:
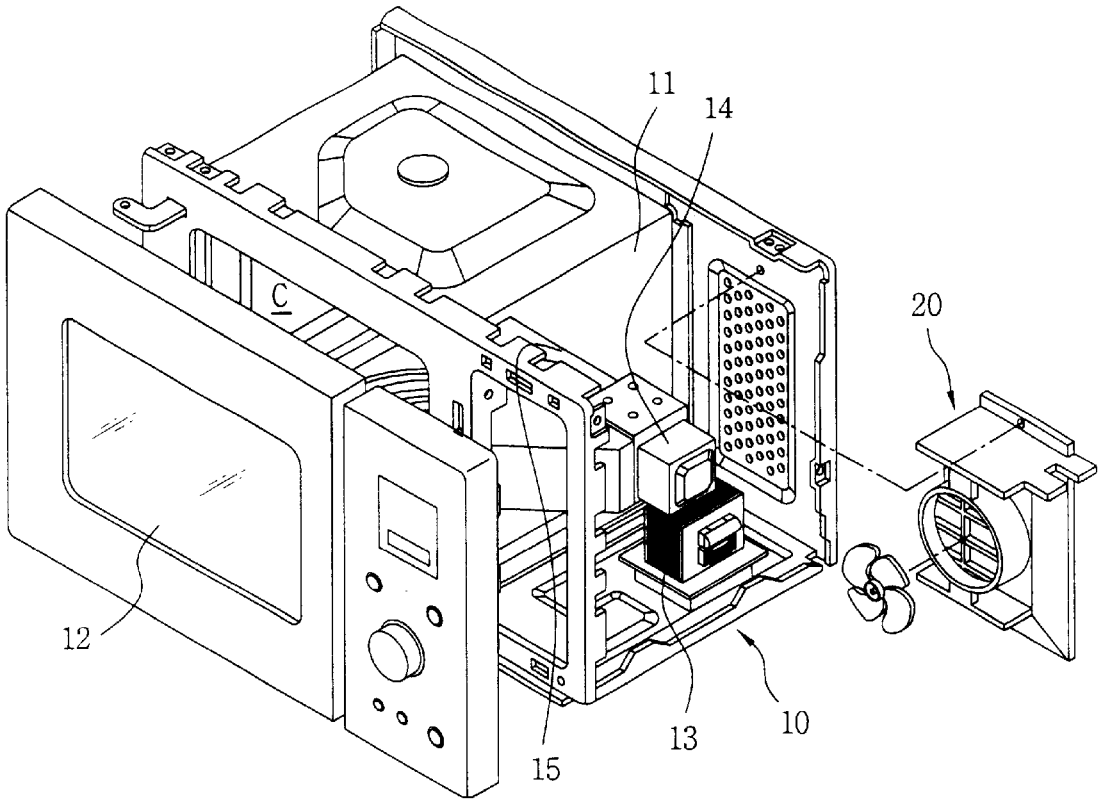
FIG. 1 CONVENTIONAL ART
FIG. 1 is a perspective view illustrating a general microwave oven.
Figure 2:
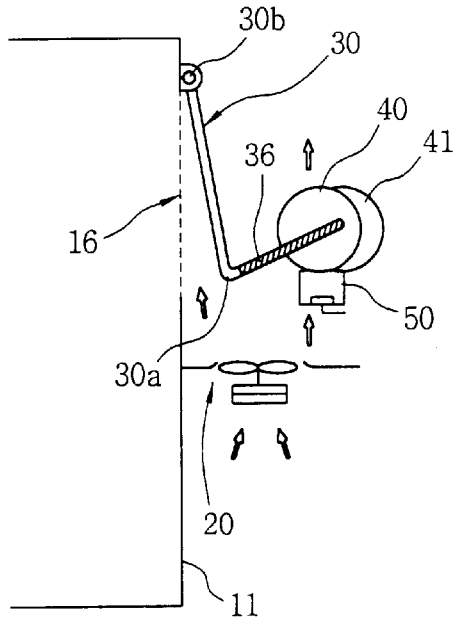
FIG. 2 CONVENTIONAL ART
FIG. 2 is a block diagram illustrating the construction of a conventional damper apparatus for a microwave oven.
Figure 3:
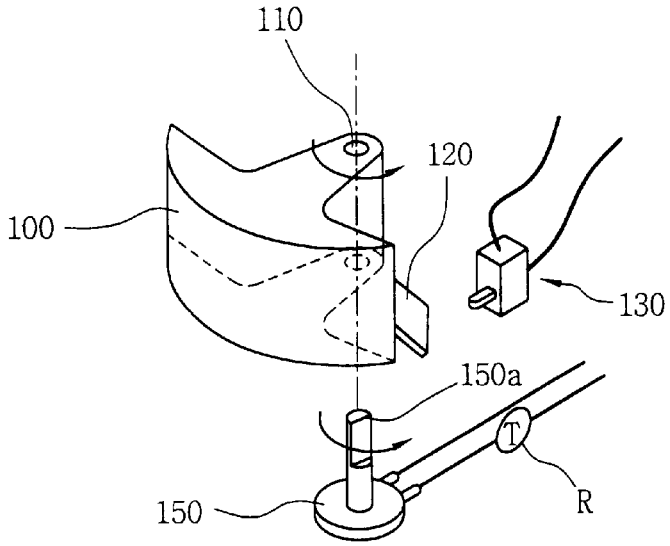
FIG. 3 is a schematic view illustrating the basic construction of a damper apparatus according to the present invention.
Figure 4:
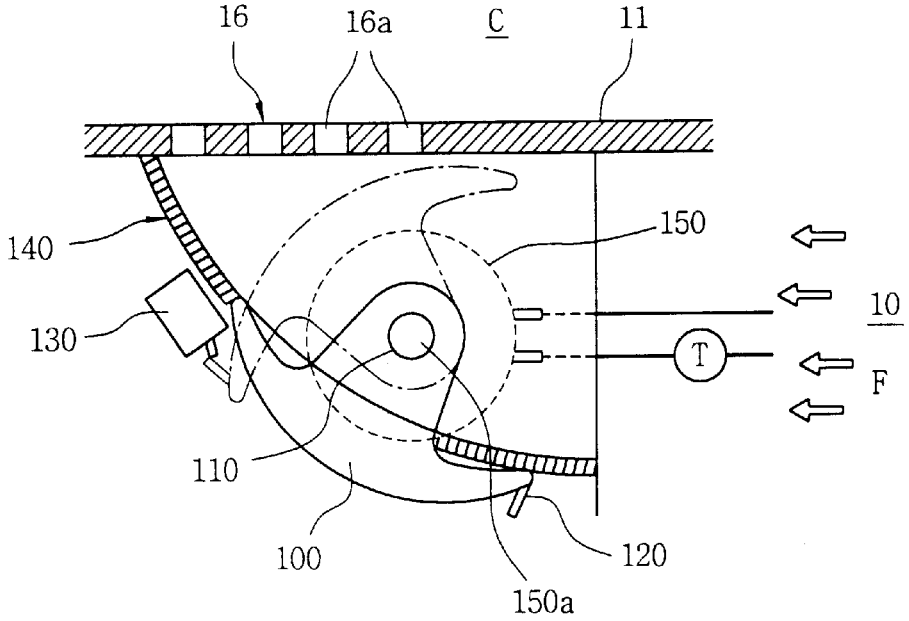
FIG. 4 is a block diagram illustrating the open-close operation of a damper apparatus according to the present invention.

FIG. 3 is a schematic view illustrating the basic construction of a damper apparatus according to the present invention. FIG. 4 is a plane view illustrating the open-close operation of a damper according to the present invention. Reference numeral 11 denotes a partition between a cavity (C) and a machinery compartment 10, which is provided with an inlet port 16 formed of a plurality of air vents 16*a* in order to introduce air into the cavity (C).

As illustrated therein, the damper apparatus comprises an air duct 140 which is installed on the partition 11 in order to guide air to the inlet port 16; a motor which is installed at the inside of the air duct 140 and has a rotation shaft 150*a*; a damper having a rotation shaft hole 110 into which the rotation shaft of the air duct 150 is inserted formed therein; and a position control unit 120 which is installed at one end of the damper 100 and controls the rotation of the damper 100 by contacting a micro switch 130.

Herein, the damper 100 is formed into an anchor or fan shape, the rotation shaft hole 110 is formed at the center of the rotation of the damper 100 to thereby block air to the inlet port 16 by closing the inside of the air duct 140, or introduce air to the inlet port 16 by opening the air duct 140.

In addition, the rotation shaft 150*a* of the motor 150 is inserted into the rotation shaft hole 110, whereby the rotation of the motor 150 is directly transferred to the damper 100. The position control unit 120 formed at one end of the damper 100 is constructed to contact the micro switch 130 at a certain position by the rotation of the damper 100.

The operation mode of the thusly constructed damper apparatus according to the present invention will be described as follows.

First, in FIG. 4, the condition shown by the solid lines is a condition, wherein since the damper 100 is opened, air is guided by the air duct 140 to be supplied into the cavity through the inlet port 16.

In the case that food is heated in a microwave oven mostly using microwave in such a condition, because the microwave directly heats the food, there is no problem with directly heating the food, although the surrounding air temperature is decreased. Therefore, although a cold air is introduced into the cavity, there is no large difference in the heating state.

However, in the case that food is heated using a heater (not shown) individually installed, because the air temperature surrounding the food has to be heated at a very high temperature, the heat in the cavity (C) must not be exhausted to the outside. Therefore, the inlet port 16 has to be blocked using the damper 100, thereby preventing the heat in the cavity (C) to run off.

As described above, in order to perform the operation of closing the inlet port 16, when a close command is given by a micro processor (not shown) of the microwave oven, and thereby the rotation shaft 150*a* is rotated in a clockwise direction by driving the motor 150, the damper 100 is rotated in the same direction.

And, when the position control unit 120 formed at one end of the damper 100 contacts the micro switch 130, the rotation of the damper 100 is terminated so that the inlet port 16 is held at the closed condition as shown by the one-dot chain line in FIG. 4.

Therefore, a signal that the position control unit 120 has become in contact with the micro switch 130 is outputted by the micro switch 130, the micro processor of the microwave oven stops driving the motor 150.

In such a condition, food is heated by the electric heater (not shown) installed in the microwave oven while the inside of the cavity (C) maintains at a high temperature without introducing or exhausting air.

Meanwhile, the operation for opening the inlet port 16 is accomplished in the reverse order of the operation for closing the inlet port 16. Thus, the detailed description thereof is omitted.

The present invention thus described can be summarized that the motor 150 directly connects the damper 100 installed in the air duct 140 to thereby drive the same. It will obviously be suggestive of any derivation or modification from the spirit and scope desired therein by those who skilled in the arts.

For example, the position and design of the micro switch for controlling the operation of the motor 150, or the position and shape of the position control unit 120 for operating the micro switch 130 can be varied in many ways.

The damper apparatus according to the present invention thus described has an advantage of simplifying the construction thereof, while improving the reliability of the operation.

Also, the apparatus has another advantage of providing the optimum heating condition by preventing the loss of heat in the cavity, and improving the heating characteristics of the microwave oven.

What is claimed is:

1. A damper apparatus for a microwave oven, comprising:

an air duct for guiding cooling air from a machinery compartment of said microwave oven into an oven cavity;

a damper rotatably installed in said air duct, for opening or closing the flow of air in the air duct;

a motor which includes a shaft directly connected to said damper without any cam device to thereby rotate the damper; and a micro switch for detecting the opening and closing states of the damper by contacting one end of the damper.

2. The apparatus of claim 1, wherein said micro switch detects a closing state of the air duct when said damper is contacted to the micro switch and an opening state of the air duct when the damper is separated from the micro switch.

3. The apparatus of claim 1, wherein said air duct includes an opening through which the damper rotates, and said micro switch is mounted on one end of said opening.

4. The apparatus of claim 1, wherein said damper includes a rotation shaft hole for being connected to the shaft of the motor, and a damper portion which is fan or anchor shaped, and wherein the air duct has an opening in a wall thereof, the damper being rotatable by the motor so as to close the opening in the wall of the air duct in the opening state of the damper.

5. A damper apparatus for a microwave oven, comprising:

an air duct for guiding cooling air from a machinery compartment of said microwave oven into an oven cavity and installed on one side wall of the oven cavity;

a damper rotatably installed in said air duct, for opening or closing the flow of air in the air duct;

a motor which includes a shaft directly connected to said damper without any cam device to thereby rotate the damper, said shaft being parallel to the side wall of the oven cavity; and a micro switch for detecting the opening and closing states of the damper by contacting one end of the damper.

* * * * *